US007240507B2

(12) United States Patent
Jeuch

(10) Patent No.: US 7,240,507 B2
(45) Date of Patent: Jul. 10, 2007

(54) HEAT EXCHANGER

(75) Inventor: Pierre Jeuch, Saint-Aubin (FR)

(73) Assignee: Thermagen, Gif-sur-Yvette (FR)

( * ) Notice: Subject to any disclaimer, the term of this patent is extended or adjusted under 35 U.S.C. 154(b) by 141 days.

(21) Appl. No.: 10/495,510

(22) PCT Filed: Nov. 4, 2002

(86) PCT No.: PCT/FR02/03772

§ 371 (c)(1),
(2), (4) Date: Aug. 25, 2004

(87) PCT Pub. No.: WO03/042610

PCT Pub. Date: May 22, 2003

(65) Prior Publication Data

US 2005/0039485 A1 Feb. 24, 2005

(30) Foreign Application Priority Data

Nov. 16, 2001 (FR) ..... 01 14854

(51) Int. Cl.
*F25B 19/00* (2006.01)
*F25B 17/08* (2006.01)
*F25D 3/08* (2006.01)

(52) U.S. Cl. ..... 62/269; 62/480; 62/371

(58) Field of Classification Search ..... 62/480, 62/477, 371, 530, 457.9, 457.3, 269
See application file for complete search history.

(56) References Cited

U.S. PATENT DOCUMENTS 1,857,887 A 5/1932 Stein
3,726,106 A 4/1973 Jaeger
3,970,068 A 7/1976 Sato
4,126,016 A 11/1978 Greiner
4,319,464 A 3/1982 Dodd
4,669,273 A 6/1987 Fischer et al.
4,688,395 A 8/1987 Holcomb
4,736,599 A 4/1988 Siegel
4,784,678 A 11/1988 Rudick et al.
5,018,368 A 5/1991 Steidl
5,054,544 A 10/1991 Kaubek et al.

(Continued)

FOREIGN PATENT DOCUMENTS

CH 182 955 A 3/1936

(Continued)

OTHER PUBLICATIONS

U.S. Appl. No. 10/495,572, filed May 14, 2004, entitled "Liquid/Gas State Separating Device" by Pierre Jeuch.

*Primary Examiner*—Cheryl Tyler
*Assistant Examiner*—Michael J. Early
(74) *Attorney, Agent, or Firm*—Sughrue Mion, PLLC

(57) ABSTRACT

A heat exchanger for cooling a liquid comprising a cavity (2) containing a refrigerating liquid capable of evaporation under the effect of a depression maintained by a pump. The cavity includes at least a first wall (21) in contact with the liquid to be cooled, the first wall (21) being substantially conical such that its cross-sectional surface tapers from the base towards the top, and at least a second wall (22) forming the base of the conical shape and incorporating communication (30) between the cavity (2) of the exchanger and the pump.

23 Claims, 6 Drawing Sheets

U.S. PATENT DOCUMENTS

| | | | |
|---|---|---|---|
| 5,201,183 | A | 4/1993 | Ramos |
| 5,207,073 | A | 5/1993 | Maier-Laxhuber et al. |
| 5,214,933 | A | 6/1993 | Aitchison et al. |
| 5,273,182 | A | 12/1993 | Laybourne |
| 5,331,817 | A | 7/1994 | Anthony |
| 5,440,896 | A | 8/1995 | Maier-Laxhuber et al. |
| 5,447,039 | A | 9/1995 | Allison |
| 5,692,381 | A | 12/1997 | Garrett |
| 5,765,385 | A | 6/1998 | Childs |
| 5,845,499 | A | 12/1998 | Montesanto |
| 5,865,036 | A | 2/1999 | Anthony |
| 5,943,875 | A | 8/1999 | Hymes |
| 5,946,930 | A | 9/1999 | Anthony |
| 6,065,300 | A | 5/2000 | Anthony |
| 6,089,519 | A | 7/2000 | Laybourne |
| 6,103,280 | A | 8/2000 | Tippetts et al. |
| 6,324,861 | B1 | 12/2001 | Jeuch |
| 6,338,252 | B1 | 1/2002 | Calderaio |
| 6,722,153 | B2 | 4/2004 | Jeuch |
| 2003/0115901 | A1 | 6/2003 | Jeuch |

FOREIGN PATENT DOCUMENTS

| | | | |
|---|---|---|---|
| EP | 0 261 673 | A | 3/1988 |
| EP | 0 726 433 | A1 | 8/1996 |
| EP | 0 931 998 | A2 | 7/1999 |
| FR | 322 802 | A | 2/1903 |
| FR | 528 092 | A | 11/1921 |
| FR | 2 011 939 | A | 3/1970 |
| FR | 2 696 533 | | 4/1994 |
| FR | 2 762 076 | | 10/1998 |
| SU | 1135919 | A | 1/1985 |
| SU | 1291183 | A1 | 2/1987 |
| SU | 1643897 | A1 | 4/1991 |
| SU | 1831275 | A3 | 7/1993 |
| WO | WO 97/21964 | A1 | 6/1997 |
| WO | WO 99/37958 | A1 | 7/1999 |
| WO | WO 00/77462 | A | 12/2000 |
| WO | WO 01/10738 | A1 | 2/2001 |
| WO | WO 01/11297 | A1 | 2/2001 |

HEAT EXCHANGER

BACKGROUND OF THE INVENTION

The present invention relates to a heat exchanger for the implementation of a cooling of a liquid by a method of evaporation and adsorption. The principle of such a method of cooling consists of evaporating a liquid under the effect of a reduced pressure maintained by pumping of the vapors of said liquid.

The heat exchanger according to the invention is intended to be used in a receptacle in the form of a cooling dip tube or incorporated in a self-cooling drink container. The aim of the present invention is thus to allow the consumption of a drink at an ideal temperature at any place and at any time.

The implementation of the method of cooling by evaporation and adsorption is known and has been the subject of numerous research projects in the prior art. Numerous devices have been proposed, combining a heat exchanger containing a liquid to be evaporated with a reservoir containing an adsorbent, in particular for application in self-cooling drink containers.

Thus, U.S. Pat. No. 4,928,495, an illustration of which is given in FIG. 1, discloses a self-cooling container configuration 10 (presented as a can) comprising a heat exchanger 16 in flattened rectangular form, immersed in a drink to be cooled and connected to an adsorption device 22. This patent describes a basic scheme without specifying the means of realizing such a device taking account of the economic constraints associated with an application for disposable containers.

Moreover, International patent applications WO 01/10738 and WO 01/11297 of the same inventors, an illustration of which is given in FIG. 2, also disclose a self-cooling drink container 10 comprising a cylindrical U-shaped exchanger 30. These patent applications specify the geometry of the exchanger 30 as well as the method of manufacture and assembly of such a device, compatible with the industrial constraints of high-speed industrial manufacture of drink cans.

However, the exchanger 30 as it is disclosed has several drawbacks. In fact, the effectiveness of the heat exchange between the evaporator and the drink to be cooled, which governs the speed of cooling of the drink, depends chiefly on the geometry of the exchanger. In order to obtain a satisfactory cooling effectiveness, these patent applications propose increasing the dimension of the exchanger 30 to the maximum of what can possibly be inserted into the can, i.e. a diameter of 50 mm for a height of 100 mm. The volume of the resultant exchanger is 80 ml for a consumable drink volume of 300 ml, which represents more than 25%.

Another drawback of the device disclosed in the above-mentioned international applications relates to the quantity of metal necessary to produce this exchanger 30, therefore its cost. In particular, the water to be evaporated contained in the exchanger for the implementation of the method of cooling by adsorption evaporation must be kept under vacuum in the exchanger, and the difference in pressure between the inside and the outside of the exchanger 30 requires a significant thickness of metal constituting the walls of the exchanger.

Moreover, another drawback, linked to the particular geometry of the exchanger 30 disclosed in these international applications, lies in the requirement to use a gel to fix the cooling liquid in the exchanger in order to avoid the entrainment of the liquid by its own vapors during the operation of the device.

There is further known from FR 2,011,939 a self-refrigerating device for a drinks packaging that includes a conical-shaped heat exchanger containing a pressurised fluid such as liquified freon. Release of gas pressure to the outside atmosphere leads to cooling of the drink in contact with the heat exchanger. Adiabatic expansion of pressurized gas leads to a very significant drop in temperature allowing effective cooling of the drink despite a reduced surface of contact with the drink to be cooled. Nevertheless, this method of cooling is not compatible with industrial production techniques, the pressurized gas being somewhat difficult to handle. This method is also contrary to certain environmental protection standards aimed at reducing discharge of gas to the atmosphere.

SUMMARY OF THE INVENTION

The aim of the present invention is to resolve the drawbacks of the prior art.

To this end, the present invention provides a heat exchanger the geometry and lay-out of which makes it possible to promote the speed of cooling of a drink on the principle of the evaporation of a cooling liquid at reduced pressure. Thus, the geometry of the exchanger favours the establishment of substantial convection currents in the drink in order to ensure its rapid cooling. This geometry moreover makes it possible to ensure a maximum heat exchange surface with the drink for a minimum space occupied by the exchanger.

Another objective of the invention is to generally apply the principle of cooling by evaporation under the effect of a reduced pressure to any device for cooling a liquid by the use of a heat exchanger according to the invention, for example used as a dip tube in a receptacle containing the drink to be cooled.

More particularly, the invention relates to a heat exchanger for cooling a liquid comprising a cavity containing a cooling liquid capable of evaporating under the effect of a reduced pressure maintained by pumping means, characterized in that the cavity comprises at least a first wall in contact with the liquid to be cooled, said first wall being substantially conical in shape, such that its surface area in section diminishes from the base to the top, and at least a second wall forming the base of said conical shape and integrating means of connecting the cavity of the exchanger to the pumping means.

According to one characteristic, the first wall of the cavity has a ribbed structure.

According to one feature, at least some of the ribs of the first wall of the cavity have a zero width inside the cavity.

According to embodiment features, the first wall of the cavity comprises a section the surface area of which in section is constant or the surface area in section of the first wall gradually diminishes from the base to the top.

According to another feature, the conical cavity has a rounded or flattened top.

According to one characteristic, the volume of the cavity is less than ⅔ of the volume delimited by the surface of revolution enveloping said cavity.

According to one characteristic, the cavity contains the cooling liquid and the vapors of said liquid at a pressure below atmospheric pressure.

According to an advantageous characteristic, the internal walls of the cavity are at least partially covered with a hydrophilic porous material.

According to one characteristic, the cooling liquid is water and/or water containing an additive having a saturated vapor pressure higher than that of water.

According to one embodiment, the cavity contains a liquid-gas state separating device.

According to one characteristic, at least the first wall of the cavity is made of a heat-conducting material.

According to the embodiments, the associated pumping means are chosen from the means constituted by an adsorbent air vacuum-packed material, a mechanical vacuum pump, a cryogenic vacuum pump.

The invention also relates to a self-cooling drink container comprising a first cavity containing a consumer drink, a second cavity contiguous with the first and forming a heat exchanger containing a cooling liquid and its vapor, a third cavity containing means of pumping by adsorption of said vapor and means of connecting said second and third cavities, characterized in that the second cavity is constituted by a heat-exchanger according to the invention.

According to one characteristic, the top of the conical shape of the second cavity is directed downwards so as to create at least one convection current in the axis of the cone in the first cavity during the adsorption of the vapor of the cooling liquid.

According to one characteristic, the second cavity has a volume-to-surface area ratio at least two times smaller than the volume-to-surface area ratio of the first cavity.

According to one embodiment, the first wall of the cavity of the heat exchanger is in contact with the drink contained in the first cavity.

According to another embodiment, the first wall of the cavity of the heat exchanger is adjacent to a wall of the first cavity.

According to one characteristic, the second wall of the cavity of the exchanger constitutes a wall of the third cavity and integrates means of communication between said second and third cavities.

The invention also relates to a device for cooling a drink contained in a receptacle comprising a dip tube immersed in said drink to be cooled, characterized in that the dip tube is constituted by a heat exchanger according to the invention.

According to the embodiments, the exchanger is linked to the pumping means by a tube or the exchanger is integral with the pumping means, the second wall of the cavity of the exchanger being integrated into said pumping means.

The special features and advantages of the present invention will become apparent during the description which follows, given by way of illustration and non-limitatively, and with reference to the figures in which:

DETAILED DESCRIPTION OF THE PREFERRED EMBODIMENTS

Figure 1:
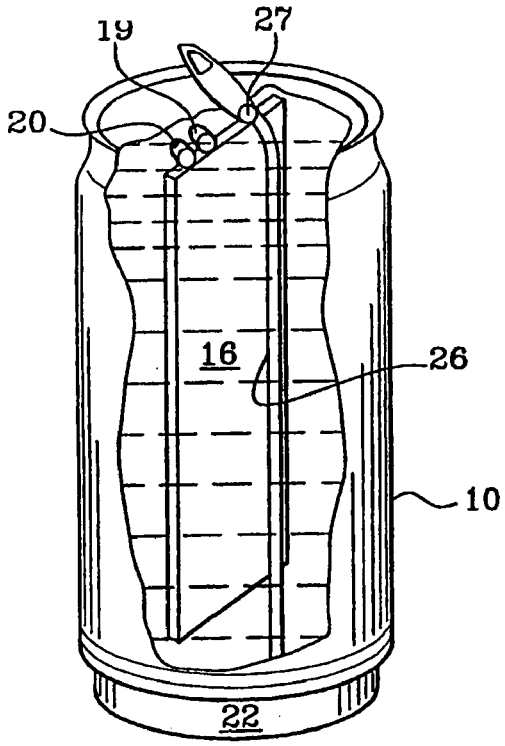
Fig. 1 PRIOR ART
FIG. 1, already described, is a diagram of a self-cooling drink can according to a variant of the prior art.
Figure 2:
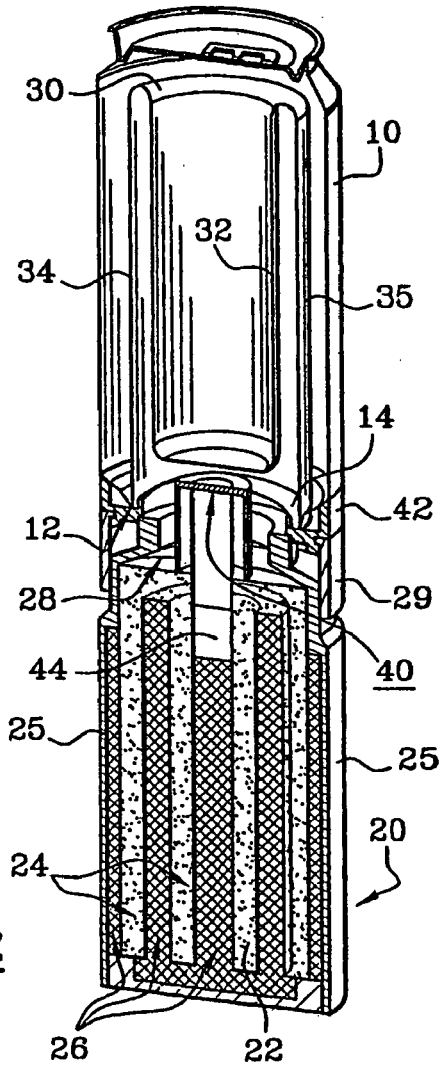
Fig. 2 PRIOR ART
FIG. 2, already described, is a diagram of a self-cooling drink can according to another variant of the prior art.
Figure 3A:
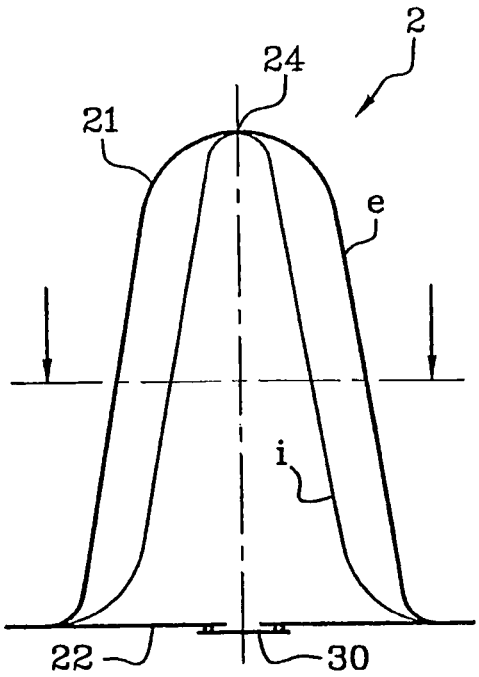
FIGS. 3*a* to 3*d* are diagrammatic views in cross-section of a heat-exchanger according to several embodiment variants of the invention.
Figure 3B:
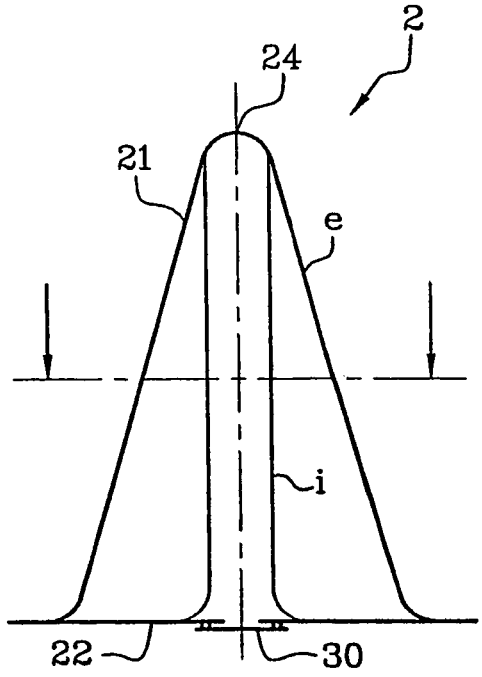
Figure 3C:
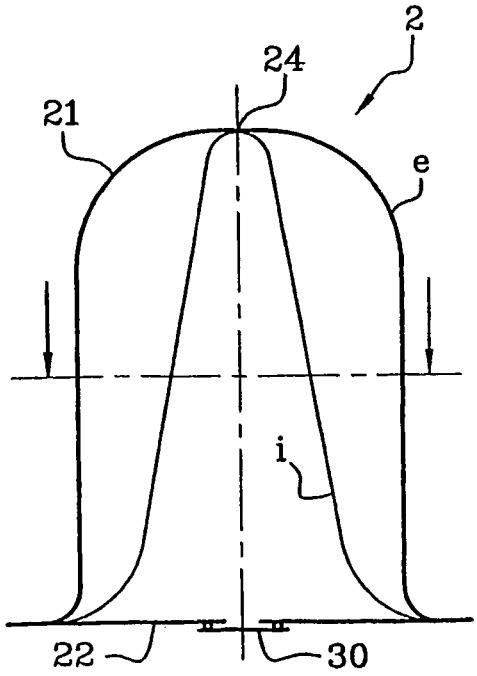
Figure 3D:
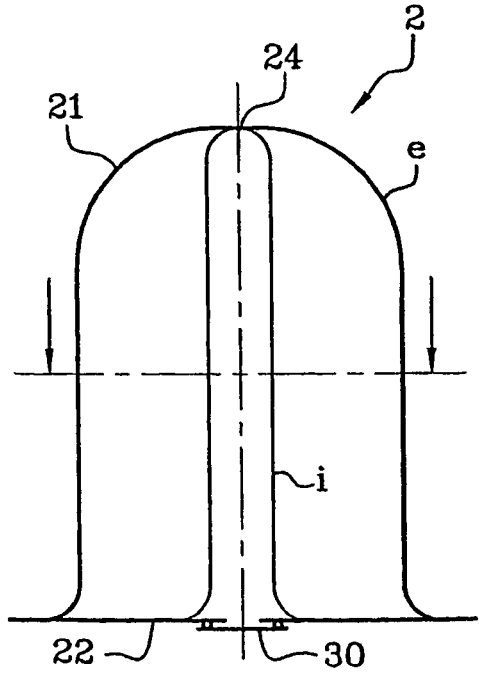

The heat exchanger according to the invention comprises a cavity 2 containing a cooling liquid capable of evaporating under the effect of a reduced pressure maintained by pumping means. The heat exchanger is intended to be immersed in a drink to be cooled. Thus it is essential for the heat exchanger according to the invention to have at least a first wall 21 in contact with the drink to be cooled and at least a second wall 22 which integrates means of communication 30 with pumping means 31.

As illustrated in the series of FIG. 3, and according to an essential characteristic of the invention, the wall 21 of the cavity 2 in contact with the liquid to be cooled is substantially conical in shape, such that its surface area in section diminishes from the base to the top. This particular geometry of the cavity 2 in fact favours the establishment of substantial convection currents in the drink in order to ensure its rapid cooling. It is important that the overall shape of the cavity is conical, in particular that its surface area in section gradually diminishes from the base to the top. Nevertheless, a straight section, which does not modify the surface area in section of the exchanger can optionally be realized over part of the height of the exchanger without detriment to its satisfactory operation. The conical forms covered by this definition can assume several possible configurations and relate to a pointed cone (3*b*) as well as a domed cylinder (3*d*).

FIGS. 4*a* to 4*d* are cross-section views from above the cavity 2 according to the invention and the embodiments illustrated in these figures can be combined equally well with the embodiments illustrated in FIGS. 3*a* to 3*d*.

As illustrated in the series of FIG. 4, and according to an advantageous characteristic of the invention, the wall 21 of the cavity 2 of the heat exchanger in contact with the drink to be cooled can have a ribbed structure in order to increase the heat exchange surface area between the exchanger and the drink. FIG. 4*c* illustrates an embodiment in which the first wall 21 has no rib.

Figure 4A:
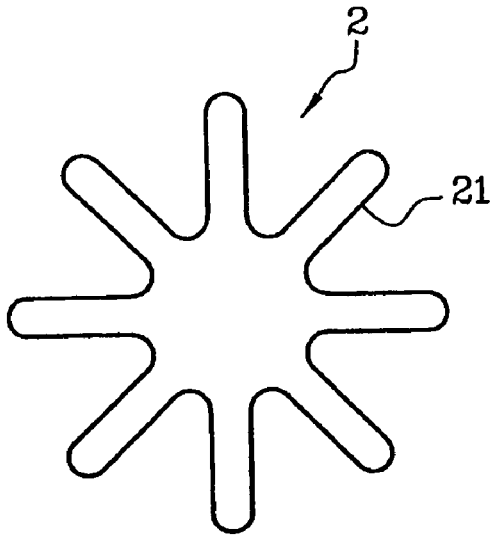
FIGS. 4*a* to 4*d* are diagrammatic views in cross-section from above according to several embodiment variants of exchangers according to the invention.
Figure 4B:
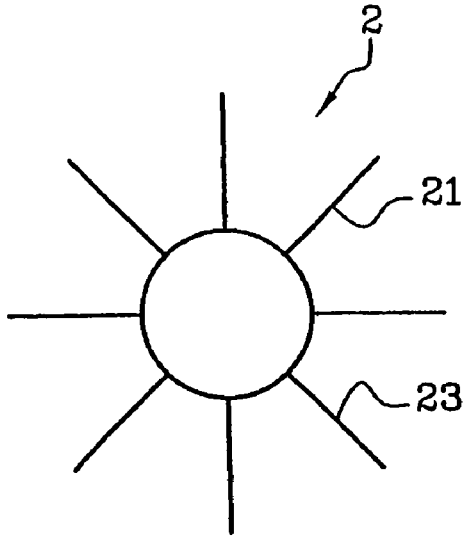
Figure 4C:
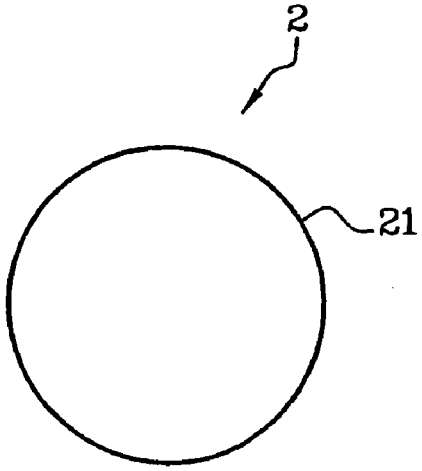
Figure 4D:
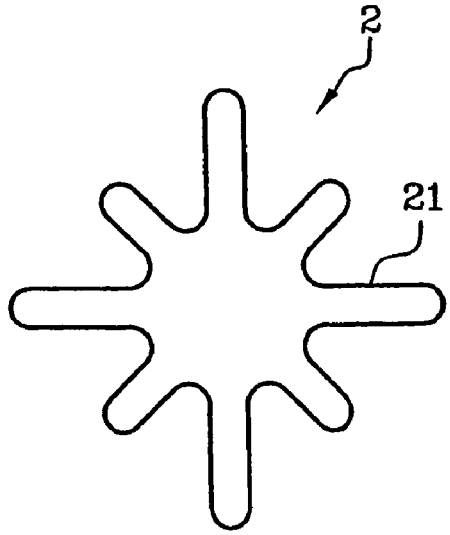

According to a particular embodiment, illustrated in FIG. 4*b*, at least some of the ribs of the first wall 21 have a zero width inside the cavity 2 so as to create vanes 23 on the cavity 2.

Thus, the first wall 21 of the exchanger can be defined as being included between two internal and external surfaces of revolution (referenced i and e in FIGS. 3*a* to 3*d*) merging at the base of the cone, i.e. at the junction line with the second wall 22 of the exchanger integrating means of communication 30 with pumping means. These surfaces i and e can be advantageously constituted by an assembly of cones, cylinders, toroids, spheres or any other more complex surface, realized by drawing for example. The top 24 of the cone is also defined as being the point of the wall 21 furthest away from the base 22 being situated substantially on the axis of surfaces of revolutions previously described.

The top 24 of the cone 21 of the exchanger according to the invention can be rounded without detriment to the effectiveness of the heat exchange. The reason for this rounding is a desire to avoid any incident when the emptied container containing this exchanger is crushed.

The advantages procured by such a geometry of the heat exchanger according to the invention are many. In operation, the exchanger according to the invention is oriented with the top of the cone downwards. The heat-exchange surface area, smaller than that of known exchangers, is largely compensated for by an acceleration of the convention currents produced in the axis of revolution of the cone according to what is called a "reversed flue" effect, whereby all the cooled water veins in contact with the wall of the exchanger flow towards the axis of the cone. This produced column of cold liquid reinforces the pressure gradient and creates cold convection currents rising by a "reversed flue" effect without being slowed by the surface of the exchanger. Thus an exchange surface area of the order of 100 $cm^2$ makes it possible to achieve performances equivalent to those of known exchangers having an exchange surface area of more than 300 $cm^2$ with a plane geometry. Due to its geometry, the exchanger according to the invention allows the establishment of a strong axial convection current rather than the formation of cells of non-axial secondary convection currents.

The ribbed cone structure in particular makes it possible to obtain a significant heat-exchange surface area in a limited occupied space, specifically a limited height, which allows an advantageous application for sealed drink containers. For example, the height of the ribbed-cone exchanger can be limited to less than half the height of the receptacle containing the drink to be cooled.

Typical values of the geometry of an exchanger according to the invention can be the following, given without limitative character but purely by way of embodiment example:

Exchange surface area=100 $cm^2$

Internal volume=40 $cm^3$

Space occupied=60 $cm^3$ (defined by the surface of revolution of the envelope of the exchanger)

Height=5 cm

The cavity of the exchanger is composed of a heat-conducting material, such as steel or aluminium for example. As the surface area of the exchanger according to the invention is reduced, the quantity of metal necessary for its manufacture is reduced, which also reduces its cost.

Moreover, this structure allows a good resistance to the external pressure exerted on the cavity of the exchanger by the drink to be cooled. The thickness of metal constituting the cavity can consequently be reduced. In particular, a thickness of the order of 0.2 to 0.4 mm can be sufficient.

The cooling liquid contained in the cavity of the exchanger can be water, or preferably water containing an additive, for example methanol, having a high saturated vapor pressure making it possible to trigger the boiling of the cooling liquid more rapidly and to reduce the projection of drops which can be violent at the start of the pumping process.

According to an advantageous feature, the liquid only partially, for example half, fills the cavity.

According to another feature of the invention, the cavity of the exchanger contains only the cooling liquid and the vapors of said liquid, i.e. the liquid has previously been degassed before being introduced into the cavity. This degassing can be carried out, in particular, by boiling at atmospheric pressure followed by boiling by reduction of pressure to a few millibars. The cooling liquid is then placed in the cavity of the exchanger under air vacuum. In other words, the partial pressure, in the exchanger, of the gases other than the vapor of the cooling liquid, before being connected to the pumping means, is lower than or equal to 1 mb. This feature makes it possible to ensure a good rate of evaporation by avoiding limiting the evaporation reaction with non-adsorbable gases which might be contained in the cavity.

According to another advantageous feature, the internal walls of the cavity 2 of the exchanger are covered, at least partially, with a hydrophilic porous material, such as cellulose, a fabric or a polymer for example. This porous layer can be bonded for example. The heat-exchange wall 21 is thus wetted on its internal surface which promotes a better evaporation and thus a better cooling on the exchange surface. Preferably, a spaced-mesh fabric is used in order to promote the evaporation of the cooling liquid in contact with the metal of the exchanger while still letting the vapor of said liquid escape through the porous layer. Thus the heat resistance of the porous layer is eliminated.

Figure 5:
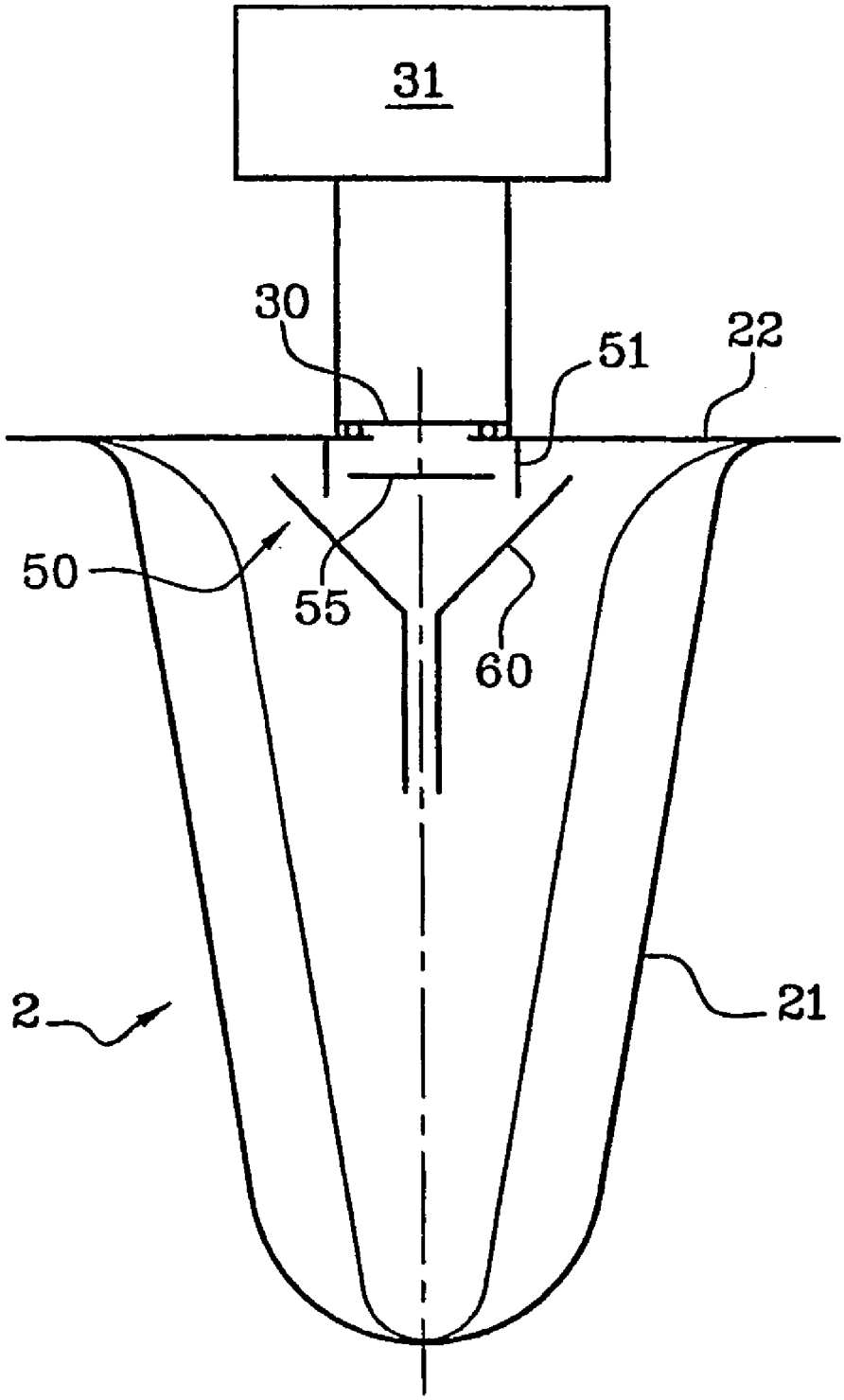
FIG. 5 is a diagrammatic view in cross-section of a particular embodiment variant of the heat exchanger according to the invention.

According to a method of implementation, illustrated in FIG. 5, the cavity 2 of the exchanger can contain a liquid-gas separation device 50. This embodiment is possible due to the particular geometry of the cavity 2 constituting the exchanger according to the invention. In fact, a large volume is available at the base of the cone, precisely close to the second wall 22 integrating the means of communication 30 with the pumping means 31. It is thus possible to arrange, inside the exchanger itself a liquid-gas separation device 50 close to the opening of said means of communication 30. Such a device is described hereafter and could not be easily implemented in an exchanger of a geometry known from the prior art. The state separation device 50 arranged in the exchanger according to the invention occupies a volume of less than 20 $cm^3$.

Such a liquid-gas state separator 50 makes it possible to separate the molecules of vapor of the pumped cooling liquid from the drops of said liquid entrained by the vapor of said liquid. In fact, according to the physical principle of cooling implemented by evaporation, the cooling liquid evaporates under the effect of a reduced pressure initiated by a breaking of the vacuum and maintained by a pumping of the vapors of said liquid. The pumping force can be such that drops of liquid can be entrained towards the pump 31, and thus be detrimental to its satisfactory operation. It is therefore necessary to provide a liquid-gas state separator 50 which lets the vapors of the coolant liquid to be pumped pass, and which returns the drops of liquid into the cavity 2 of the heat exchanger.

Such a state separator comprises a vapor deflector which comprises at least one wall forming a baffle 51 requiring one or more sudden changes in direction of the vapor flow. The vapor molecules have a very small free path length, of the order of a micrometre, which means that they can change direction very rapidly. On the other hand, the drops of liquid have a mass such that they are entrained by their inertia and thus separated from the gaseous flow. This mechanism advantageously allows a liquid-gas separation without significant slowing-down of the vapor flow and therefore does not require the occupation of a large volume.

The state separating device also comprises, supplementarily, a drop collector 60 making it possible to return the drops of liquid separated from the gaseous vapor flow to the bottom of the cavity of the evaporator 2. The collector 60 comprises a funnel and a least one flow tube for the drops. The funnel can advantageously contribute to forming the baffle 51 of the vapor deflector.

According to an advantageous embodiment, the vapor deflector 51 is advantageously arranged about means of communication 30 with the pumping means 31 and the funnel of the drop collector 60 defines a solid angle which includes said means of communication 30 and the vapor deflector 51.

Preferably, the flow tube for the drops from the collector 60 has a length greater than or equal to the loss of head of the vapor in the baffle 51 in order to avoid the projection of drops through said flow tube. This loss of head is advantageously measured by the water volume height. If, for example, a loss of head of the vapor V of 1 mb (corresponding to 1 cm of water column height) is considered, the tube will be at least 1 cm long.

According to an advantageous feature, the state separating device moreover comprises means of protection 55 against the direct projection of drops which supplement the vapor deflector 51. These protection means 55 are arranged facing the means of communication 30 in order to avoid direct pollution of the pumping means 31 in particular during the initiation of the adsorption reaction.

Depending on the applications, the pumping means 31 associated with the heat exchanger 2 according to the invention can be constituted by a mechanical vacuum pump, or cryogenic pumping means such as cold traps which condense the water vapors, or also by a cartridge under air vacuum containing reagents (desiccants) capable of triggering and maintaining the adsorption of the liquid. The implementation of the cooling is therefore initiated by a connection 30 of the heat exchanger 2 according to the invention to pumping means 31. According to an advantageous feature of the invention, it is the wall of the cavity forming the base 22 of the cone which comprises the means of communication 30 integrated into said wall 22.

Figure 6:
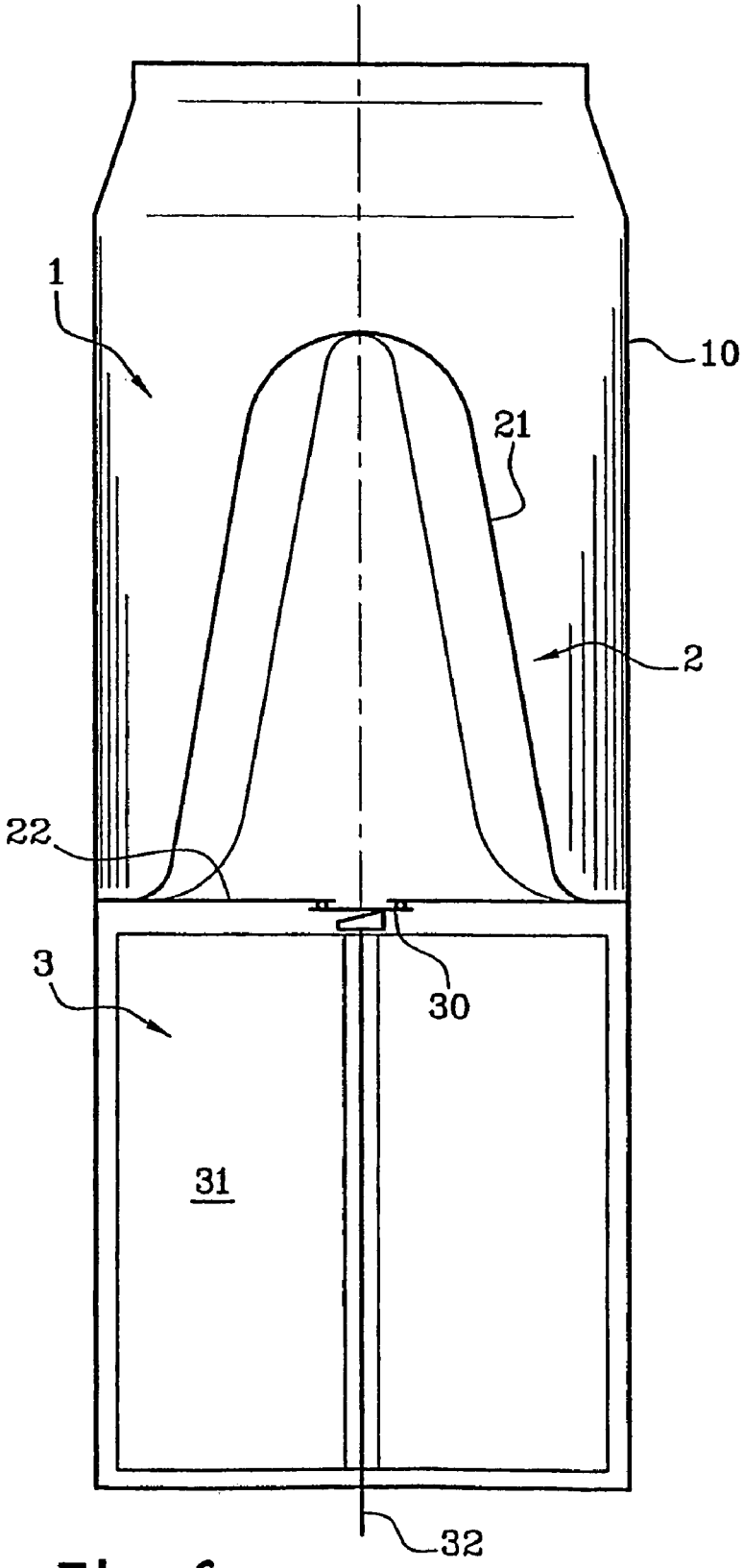
FIG. 6 is a diagrammatic view in cross-section of a drink container comprising a heat exchanger according to the invention.

As illustrated in FIG. 6, the invention also relates to a drink container 10 containing a heat exchanger according to the invention as previously described.

Such a self-cooling drink container 10 comprises a first cavity 1 containing a consumer drink. This first cavity 1 can present the forms and dimensions of a standardized can. A second cavity 2 is contiguous with the first cavity and constitutes a heat exchanger according to the already described forms and features of the invention.

According to an advantageous embodiment, the first, conical, wall 21 of the second cavity 2 is in contact with the drink contained in the first cavity 1.

According to another embodiment, the first, conical, wall 21 of the second cavity 2 is adjacent to a wall of the first cavity 1. These walls are thus in close contact in order to ensure a good heat transfer. They can nevertheless be constituted by different materials, for example the wall 21 of the cavity of the heat exchanger 2 is made of metal, whereas the wall of the cavity 1 containing the drink is made of PET (polyethylene terephthalate) plastic. Although this embodiment is less advantageous as regards the effectiveness of the heat exchange between the exchanger 2 and the drink, it allows for example good control of a sterile environment of the cavity 1 containing the drink, for example for an application for milk products.

Advantageously, the second cavity 2 forming the heat exchanger has a volume-to-surface area ratio at least two times smaller than the volume-to-surface area ratio of the first cavity 1 containing the drink to be cooled.

The cooling of the drink contained in the first cavity 1 (the can) is achieved by the evaporation of the cooling liquid contained in the second cavity 2 (the heat exchanger). This evaporation is initiated by a reduced pressure caused in the cavity 2 of the exchanger by actuation of means of communication 30 with the cavity forming the heat exchanger to pumping means 31, then this reduced pressure is maintained by a pumping of the vapors of said liquid.

To this end, the self-cooling drink container according to the invention comprises a third cavity 3 containing pumping means 31, in this case a reservoir of desiccants capable of adsorbing the vapors of the cooling liquid according to a known physical principle mentioned previously.

According to a preferred embodiment, the conical wall 21 of the second cavity 2 forming the exchanger also constitutes a wall of the first cavity 1 containing the liquid to be cooled. Similarly, the wall forming the base 22 of the cone of the second cavity 2 forming the heat exchanger also constitutes a wall of the third cavity 3 containing the desiccants, this shared wall 22 integrating the means of communication 30 with said second and third cavities. Advantageously, the third cavity 3 can comprise means of actuation 32 of the means of communication 30 such as a rod triggering the opening of said means of communication 30.

According to another application, the heat exchanger according to the invention can be used in a device for cooling a drink contained in an open container as a cooling dip tube.

In a first embodiment variant, an illustration of which can be given by FIG. 5, the cooling dip tube comprises a heat exchanger according to the invention with a substantially conical cavity 2 linked to pumping means 31 by means of connection 30 integrated in the wall 22 forming the base of the cavity 2. The heat exchanger is then alone provided with its integrated means of communication 30 and must be linked to suitable pumping means 31, such as a mechanical or cryogenic vacuum pump or a cartridge under air vacuum containing desiccants, by a tube which can be flexible or rigid, fixed or removable.

Figure 7:
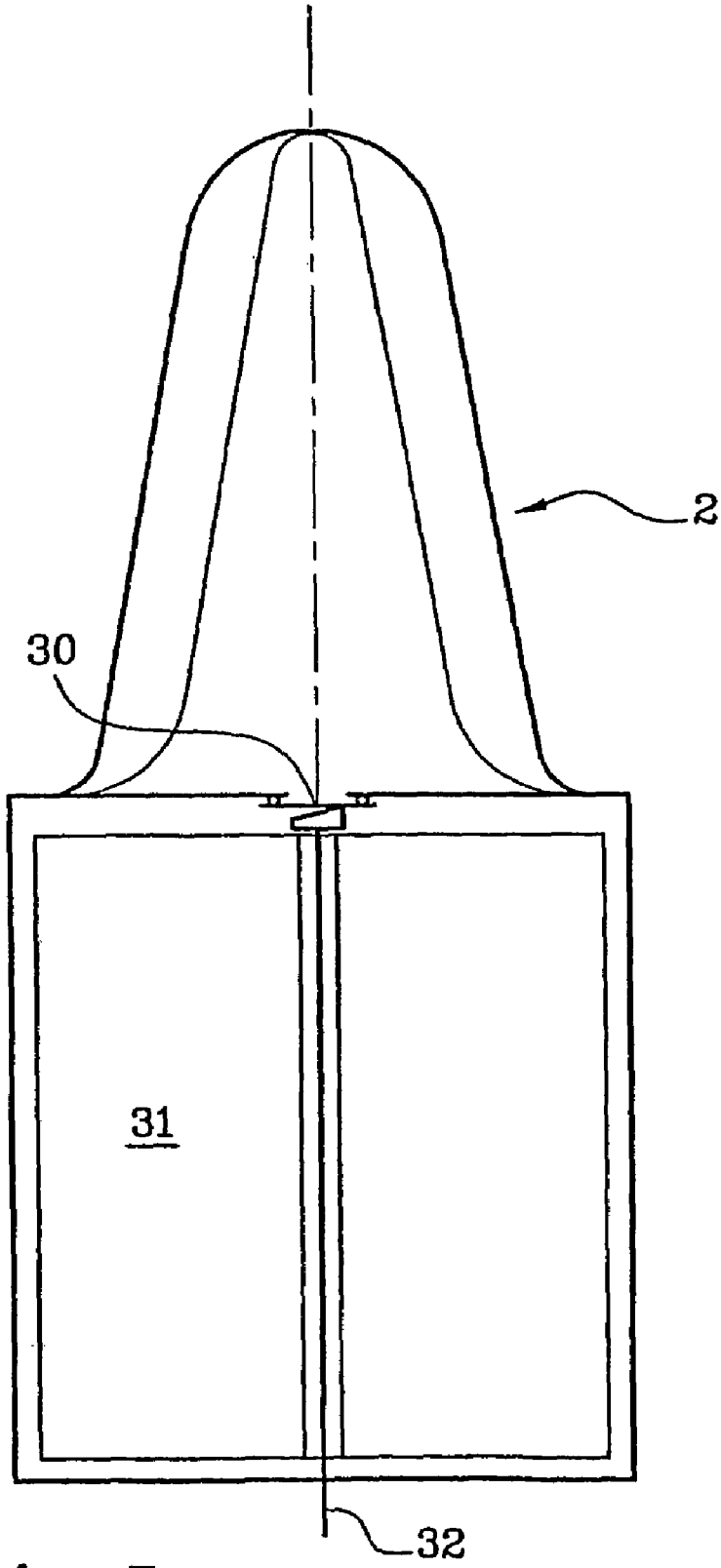
FIG. 7 is a diagrammatic view in cross-section of a cooling dip tube comprising a heat exchanger according to the invention.

In a second embodiment variant, illustrated in FIG. 7, the cooling dip tube comprises a heat exchanger according to the invention with a substantially conical cavity 2 integral with pumping means by the wall 22 forming the base of the cavity 2. The heat exchanger is then provided with integrated means of communication 30 and suitable pumping means 31, such as a cartridge under air vacuum containing desiccants. The dip tube thus constitutes an autonomous cooling device, disposable or optionally reusable after regeneration.

The invention claimed is:

1. A liquid cooling device comprising:

a heat exchanger comprising a cavity containing a cooling liquid capable of evaporating under the effect of a reduced pressure and the vapors of said cooling liquid at a pressure below atmospheric pressure, pumping means adapted to pump the vapors of said cooling liquid so as to maintain a sub-atmospheric pressure in said cavity, said cavity of the heat exchanger having at least a first wall substantially conical in shape, such that its surface area in section diminishes from the base to the top, and at least a second wall forming the base of said conical shape, said first conical wall being designed to be in contact with the liquid to be cooled and said second wall incorporating means of connecting the cavity of the exchanger to the pumping means, the cavity of the heat exchanger being at a pressure below atmospheric pressure before connection to the pumping means.

2. The cooling device according to claim 1, wherein the first wall of the cavity has a ribbed structure.

3. The cooling device according to claim 2, wherein at least some of the ribs of the first wall have substantially no internal volume contributing to said cavity.

4. The cooling device according to claim 1, wherein the first wall of the cavity comprises a portion having a constant surface area in section.

5. A cooling device according to claim 1, wherein the surface area in cross-section of the first wall of the conical cavity gradually reduces from the base to the top.

6. The cooling device according to claim 1, wherein the conical cavity has a rounded or flattened top.

7. The cooling device according to claim 1, wherein the volume of the cavity is less than ⅔ of the volume delimited by the surface of revolution enveloping said cavity.

8. The cooling device according to claim 1, wherein the internal walls of the cavity are at least partially covered with a hydrophilic porous material.

9. The cooling device according to claim 1, wherein the cooling liquid is at least one of water and water containing an additive having a saturated vapor pressure higher than that of water.

10. The cooling device according to claim 1, wherein the cavity contains a liquid-gaseous state separating device.

11. The cooling device according to claim 1, wherein at least the first wall of the cavity is made of a heat-conducting material.

12. The cooling device according to claim 1, wherein the associated pumping means is selected from the group consisting of an adsorbent air vacuum-packed material, a mechanical vacuum pump, and a cryogenic vacuum pump.

13. A liquid cooling device, comprising:

a heat exchanger comprising a cavity containing a cooling liquid capable of evaporating under the effect of a reduced pressure and the vapors of said cooling liquid at a pressure below atmospheric pressure, pumping means adapted to pump the vapors of said cooling liquid so as to maintain a sub-atmospheric pressure in said cavity, said cavity of the heat exchanger having at least a first wall substantially conical in shape, such that its surface area in section diminishes from the base to the top, and at least a second wall forming the base of said conical shape, said first conical wall being desianed to be in contact with the liquid to be cooled and said second wall incorporating means of connecting the cavity of the exchanger to the pumping means wherein the cavity of the heat exchanger constitutes a dip tube for immersion in the liquid to be cooled.

14. The cooling device according to claim 13, wherein the cavity of the exchanger is linked to the pumping means by a tube.

15. The cooling device according to claim 13, wherein the cavity of the exchanger is integral with the pumping means, the second wall of the cavity of the exchanger being integrated into said pumping means.

16. A self-cooling drink container comprising:

a first cavity containing a consumer drink, a second cavity constituted by a heat exchanger containing a cooling liquid capable of evaporating under the effect of a reduced pressure and the vapors of said cooling liquid at a pressure below atmospheric pressure, a third cavity containing pumping means adapted to absorb the vapors of said cooling liquid so as to maintain a sub-atmospheric pressure in said second cavity, said cavity of the heat exchanger having at least a first wall substantially conical in shape, such that its surface area in section diminishes from the base to the top, and at least a second wall forming the base of said conical shape, said first conical wall being designed to be in contact with the drink contained in said first cavity, and said second wall incorporating means of connecting the cavity of the exchanger to the pumping means, the cavity of the heat exchanger being under air vacuum before connection to the pumping means.

17. The self-cooling drink container according to claim 16, wherein the top of the conical shape of the second cavity is directed downwards so as to create at least one convection current in the axis of the cone in the first cavity during the adsorption of the vapor of the cooling liquid.

18. The self-cooling drink container according to claim 16, wherein the second cavity has a volume-to-surface area ratio at least two times smaller than the volume-to-surface area ratio of the first cavity.

19. The self-cooling drink container according to claim 16, wherein the first wall of the cavity of the heat exchanger is in contact with the drink contained in the first cavity.

20. The self-cooling drink container according to claim 16, wherein the first wall of the cavity of the heat exchanger is adjacent to a wall of the first cavity.

21. The self-cooling drink container according to claim 16, wherein the second wall of the cavity of the exchanger constitutes a wall of the third cavity and incorporates means of communication with said second and third cavities.

22. The self-cooling drink container according to claim 16, wherein the cavity contains a liquid-gas state separating device.

23. The cooling device according to claim 1, wherein partial pressure in the cavity of the heat exchanger, of the gases other than the vapor of the cooling liquid, is lower than or equal to 1 mbar before connection to the pumping means.

* * * * *